United States Patent [19]

Morton

[11] Patent Number: 4,941,288

[45] **Date of Patent: * Jul. 17, 1990**

[54] WINDOW ASSEMBLY OF RIGID PLASTICS MATERIAL

[75] Inventor: Philip G. Morton, Germantown, Ohio

[73] Assignee: Dayton Extruded Plastics, Inc., Springboro, Ohio

[ * ] Notice: The portion of the term of this patent subsequent to May 23, 2006 has been disclaimed.

[21] Appl. No.: 354,497

[22] Filed: May 19, 1989

Related U.S. Application Data

[63] Continuation of Ser. No. 115,895, Nov. 2, 1987, Pat. No. 4,831,781.

[51] Int. Cl.[5] ..... E06B 1/30

[52] U.S. Cl. ..... 49/504; 49/408

[58] Field of Search ..... 49/404, 408, 458, 504, 49/DIG. 1, DIG. 2; 52/209

[56] References Cited

U.S. PATENT DOCUMENTS

| | | | |
|---|---|---|---|
| 3,636,660 | 1/1972 | Peterson | 49/408 |
| 4,259,813 | 4/1981 | Winner et al. | 49/504 |
| 4,428,156 | 1/1984 | Malm et al. . | |
| 4,553,361 | 11/1985 | Ralph | 49/408 X |
| 4,555,868 | 12/1985 | Mancuso . | |
| 4,569,154 | 2/1986 | Bayer . | |
| 4,580,366 | 4/1986 | Hardy | 49/458 X |
| 4,831,781 | 5/1989 | Morton | 49/504 |

FOREIGN PATENT DOCUMENTS

| | | | |
|---|---|---|---|
| 2131072 | 6/1984 | United Kingdom | 49/408 |
| 2179693 | 3/1987 | United Kingdom | 49/504 |

*Primary Examiner*—James R. Brittain

*Attorney, Agent, or Firm*—Jacox & Meckstroth

[57] ABSTRACT

A rectangular window frame includes a pair of vertical jamb members rigidly connected by a head member and a sill member all formed from extrusions of rigid plastics material. Each jamb and head member includes an inner section which snap-fits laterally into an outer section, and each outer section has a cross-sectional profile corresponding to that of the sill member to provide the frame with rigid fusion-welded mitered corner joints and a sill member with a low profile. The inner sections of the jamb and head members define channels for slidably receiving window units including a pair of rectangular sash frames each formed from extrusions and including snap-fit extruded cap members. The sash frames also receive removable extruded glazing strips which retain glass window panels within the sash frames.

18 Claims, 1 Drawing Sheet

WINDOW ASSEMBLY OF RIGID PLASTICS MATERIAL

RELATED APPLICATION

This application is a continuation of application Ser. No. 115,895, filed Nov. 2, 1987, U.S. Pat. No. 4,831,781.

BACKGROUND OF THE INVENTION

In the art of window assemblies which include rectangular window and sash frames formed of sections of extruded rigid vinyl or similar plastics material, it is desirable to have rigid fusion-welded mitered corner joints on all of the frames while minimizing the volume of plastics material in each section. It is also desirable for the window frame to have vertical jamb members with a different cross-sectional configuration or profile than that of the horizontal head member or that of the sill member of the frame and to minimize the height of the sill member. For example, it is desirable for the sill member of a double-hung window frame to have an outwardly and downwardly sloping wall while the head member defines a channel for receiving the upper sash frame. On the other hand, it is desirable for each of the vertical jamb members of the window frame to define a pair of channel-like tracks for receiving support slides or shoes which pivotally support the sash frames. Preferably, the jamb members also define smaller channels for receiving and retaining a rectangular screen frame. However, the different cross-sectional profiles for the jamb, head and sill members make it difficult to obtain rigid and clean looking fusion-welded mitered corner joints while also minimizing the volume of plastics material in each member.

SUMMARY OF THE INVENTION

The present invention is directed to an improved rectangular window assembly which may be of the double-hung style or sliding style and which incorporates sections of extruded plastics material assembled together to provide all of the desirable features mentioned above. In accordance with a preferred embodiment of the invention, a window assembly includes a rectangular window frame having vertical jamb members rigidly connected by a horizontal head member and a horizontal sill member. Each of the jamb members and the head member include an inner adaptor extrusion or section which snap-fits laterally into a corresponding outer extrusion or section, and the outer sections of the jamb and head members have a cross sectional profile corresponding to that of the sill member. This structure provides for obtaining rigid heat or fusion-welded mitered corner joints having a smooth and clean appearance and also permits minimizing the height of the sill and the total weight of material in the frame. The inner section of each jamb member cooperates with the corresponding outer section to form a pair of vertical channel-like tracks for receiving slides or shoes which support the inner sash frames. The outer section of each jamb member also forms a narrow channel-like track for receiving the frame of a window screen.

The inner section of the head member defines a downwardly facing channel for receiving the upper sash frame, and the inner section also cooperates with the outer section of the head member to support a snap-on closure or trim strip. The inner sections of the jamb members have sloping walls which mate at the corners with the outwardly and downwardly sloping wall of the sill member to provide the sill member with a low profile.

Other features and advantages of the invention will be apparent from the following description, the accompanying drawing and the appended claims.

DESCRIPTION OF THE PREFERRED EMBODIMENT

Figure 1:
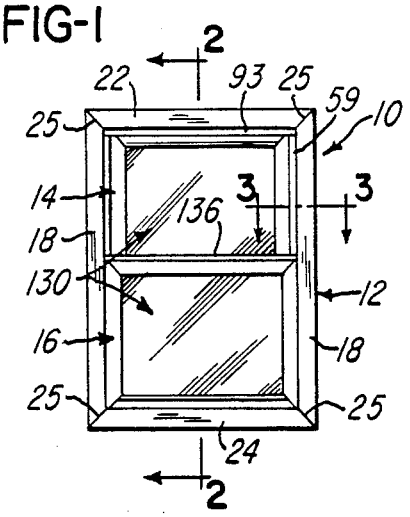
FIG. 1 is an elevational view of the inside of a double-hung window assembly constructed in accordance with the invention.

FIG. 1 illstrates generally a double-hung window assembly 10 constructed in accordance with the invention and which includes a rectangelar window frame 12 supporting movable window units including an upper sash frame 14 and a lower sash frame 16. All of the frames 12, 14 and 16 are formed from extruded sections of a rigid plastics material such as a rigid polyvinyl chloride. The window frame 12 includes a pair of verical jambe members 18 (FIG. 3) which are connected together by a horizontal header or head member 22 (FIG. 2) and a horizontal sill member 24 at mitered corner joints 25 which are fusion-welded by heat or other bonding.

Each of the jamb members 18 includes an outer section 26 (FIG. 3) and an adapter inner section 28. Each outer section 26 has parallel walls 31 and 32 and a sloping wall 33 which are integrally connected by parallel spaced walls 34, 36 and 37. The walls 32 and 33 cooperate to define a channel portion 39, and another channel portion 42 projects from the wall 33. The outer section 36 of each jamb member 18 also has a hollow rib portion 44 and a pair of hollow corner channels 46 which define slots for receiving installation and trim accessories (not shown).

The inner section 28 of each jamb member 18 has a straight rib 51 and a barbed-shaped rib 52 which interfit into the channel portions 39 and 42, respectively, and form a lateral snap-fit continuous connection of the inner section 28 to the outer section 26. Each inner section 28 also includes a wall portion 54 which cooperates with the hollow rib portion 44 of the outer sectin 26 to define a channel-like track 56. Other wall portions 58 and 59 of the inner section 28 define a second channel-like track 62 which extends parallel to the track 56. The inner section 28 of each jamb member 18 also has wall portions which define a narrow channel-like track 64 for receiving the frame of a window screen (not shown).

Figure 2:
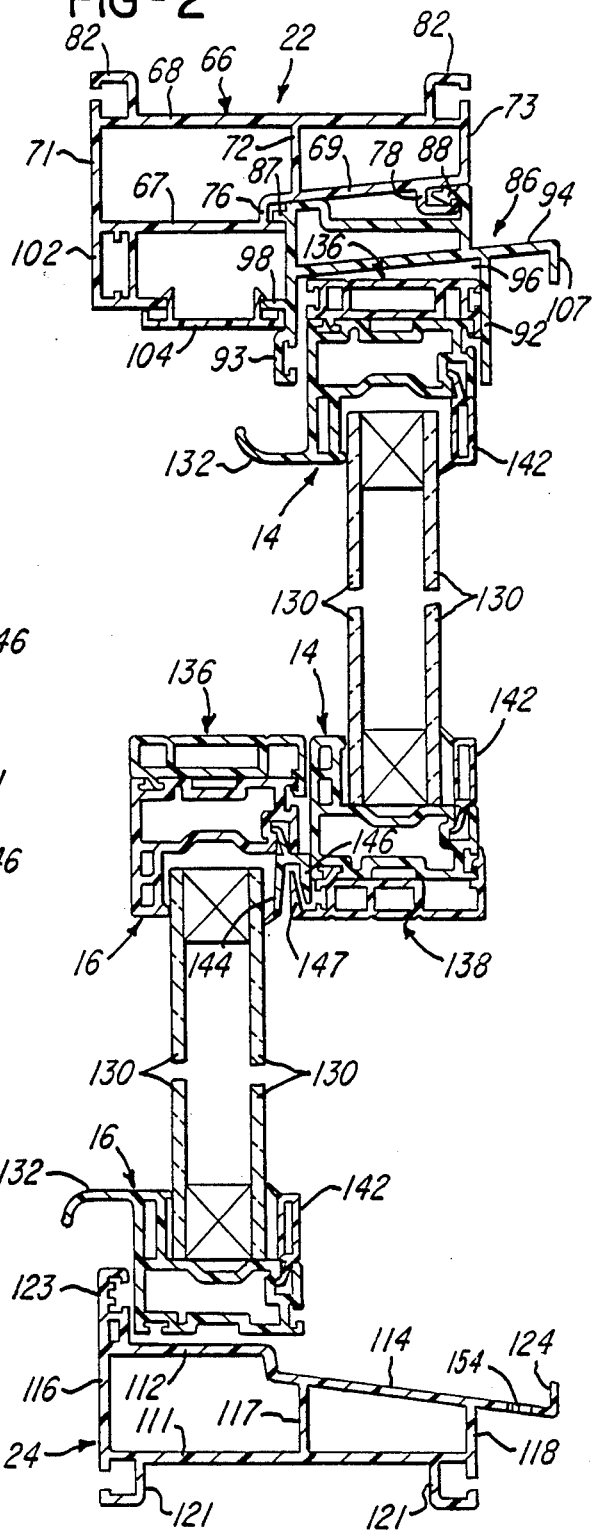
FIG. 2 is a vertical section of the window assembly, as taken generally on the line 2—2 of FIG. 1.

Referring to FIG. 2, the head member 22 includes an outer section 66 which has a cross-sectional profile the same as that of the outer section 26 of each jambe member 18. Thus the outer section 66 has parallel walls 67 and 68 and a sloping or inclined wall 69 which are integrally connected by parallel spaced walls 71, 72 and 73. The walls 67 and 69 define a channel portion 76, and another channel portion 78 projects from the wall 69. The head member 22 also has outwardly projecting ribs or channel portions 82 which define slots for retaining installation and trim accessories (not shown).

The head member 22 further includes an adaptor or inner section 86 which has projecting ribs 87 and 88 similar to the ribs 51 and 52 for interfitting into the corresponding channel portions 76 and 78 to form a lateral snap-fit continuous connection between the inner section 86 and the outer section 66 of the head member 22. The inner section 86 also has parallel wall portions 92 and 93 which are integrally connected by an inclined wall 94 to define a downwardly facing channel 96. The inner section 86 also includes an integral rib 98 which cooperates with a projecting lip on a hollow flange or rib 102 of the outer section 66 for receiving a snap-on closure or trim strip 104. The strip 104 is also formed from a section of an extrusion of rigid vinyl or plastic material. As also shown in FIG. 2, the wall portion 94 of the inner section 86 projects outwardly towards the exterior of the building and has a downwardly projecting lip 107 which cooperates with the wall 92 to define a channel for receiving the upper frame rail or member of the window screen (not shown).

As also shown in FIG. 2, the bottom sill member 24 has a cross-sectional profile substantially the same as that of the outer sections 26 of the jamb members 18 and the outer section 66 of the head member 22. That is, the sill member 24 includes parallel walls 111 and 112 and an inclined or sloping sill wall 114 which are integrally connected by parallel vertical walls 116, 117 and 118. Hollow corner ribs on channels 121 project downwardly from the wall 111 and define slots for receiving installation and trim accessories, and a rib 123 projects upwardly from the wall 112. A flange 124 projects upwardly from the outer edge of the sill wall 114 to reinforce the wall 114 and to retain the lower frame member of the window screen (not shown). The outer end portions of the flange 124 are removed (not shown) for receiving the lower end portions of the inner sections 28 of the jamb members 26.

Figure 3:
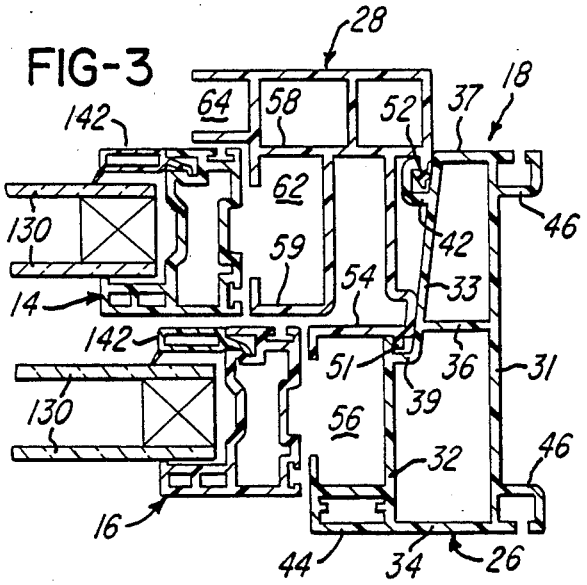
FIG. 3 is a horizontal section taken generally on the line 3—3 of FIG. 1 when the lower sash frame is raised.

As apparent from FIGS. 2 and 3, each of the sash frames 14 and 16 have substantially the same cross-sectional profile around each of the double-glazed glass window panel units 130, except that the upper frame member of the sash frame 14 and the lower frame member of the sash frame 16 has a flange 132 which projects inwardly towards the interior of the building for manually gripping each sash frame to open and close the double-hung window unit. In addition, the upper frame member of the lower sash frame and the lower frame member of the upper sash frame 14 receive a set of snap-on elongated cap members 136 and 138, respectively. The cap members 136 and 138 extend across the sash frames, except that the cap member 136 is interrupted to receive latch hardware (not shown) which has the same thickness. The upper frame member of the sash frame 14 also carries a snap-on cap member 136.

As also shown in FIGS. 2 and 3, each of the sash frames 14 and 16 receives a removable glazing strip 142 which snap-fits into the sash frame for retaining the window panel unit 130. The top frame member of the lower sash frame 16 receives a special glazing bead or strip 144 which has a flange 146 projecting downwardly to interlock with an upwardly projecting flange 147 extruded as an integral part of the cap member 138.

Figure 4:
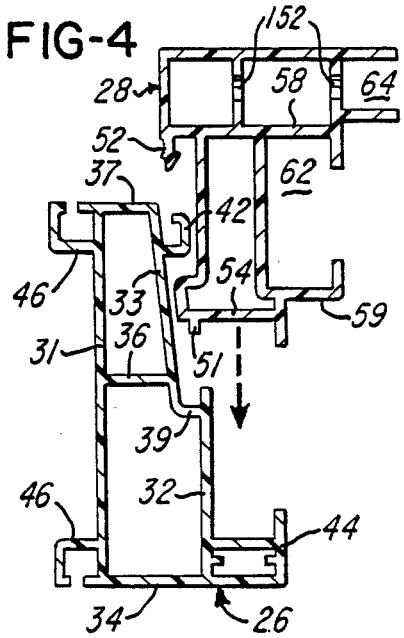
FIG. 4 is an exploded view in horizontal cross-section of the extruded sections which form a jamb member and illustrating the laterally snap-fit connection of the sections.

Referring to FIG. 3, the channel-like tracks 56 and 62 defined by the inner and outer sections of each jamb member 18 are adapted to receive vertically sliding bars or shoes (not shown) which pivotally support the corresponding sash frames 14 and 16 so that each of the window panel units 130 may be released and pivoted to a horizontal position to provide for convenient cleaning of both the inner and outer surfaces of each window panel unit. As shown in FIG. 4, the top end position of each inner section 28 has a set of holes 152 and the underlying portion of the sill 114 has a pair of holes 154 (FIG. 2). The holes 152 and 154 cooperate to allow an upward convection flow of air in the outer passages within the inner sections 28 when the inner sections 28 are heated by the sun and thereby provide for cooling of the inner sections to avoid distortions of the sections. As mentioned above, the various flexible weatherstrip extrusions which are mounted on the window and sash frames have been omitted since they form no part of the present invention.

From the drawing and the above description, it is apparent that a window assembly constructed in accordance with the present invention, provides desirable features and advantages. For example, since the outer sections 26 of the vertical jamb members 18 and the outer section 66 of the head member 22 have substantially the same cross-sectional profile as the sill member 24, the mating walls forming the outer sections and the sill member are fusion-welded at the mitered corners 25 to form a rigid and water-tight connection at each corner in addition to forming a joint which is clean in appearance. In addition, the later snap-on inner sections 28 of each jamb member 18 and the similar snap-on inner section 86 of the head member 22 are effective to form the slide tracks 56 and 62 as well as the inverted U-shaped channel 96 which receives the upper frame member of the sash frame 14. The construction of the window frame 12 further provides the sill member 24 with a low profile or minimum vertical height which is desirable to obtain maximum height of the window panel units 130 and to help minimize the total volume of plastics material used to form the sill member. In addition, the snap-on inner sections 28 of the jamb members 18 and the inner section 86 of the head member 22 cooperate to define channels for receiving a window screen unit which rests upon the outer portion of the sill wall 114.

While the form of window assembly herein described constitutes a preferred embodiment of the invention, it is to be understood that the invention is not limited to this precise form, and that changes may be made therein without departing from the scope and spirit of the invention as defined in the appended claims.

The invention having thus been described, the following is claimed:

1. A window assembly adapted for use in a vertical wall of a building, comprising a generally rectangular frame supporting a generally rectangular light transmitting window unit, said frame including a pair of elongated vertical jamb members connected by a horizontal head member and a horizontal sill member, each of said members being formed from an extrusion of rigid plastics material, each of said jamb members including an extruded outer section and an extruded inner section, each of said inner sections defining an inwardly facing recess for receiving said window unit, said sill member having an inclined wall portion sloping downwardly and outwardly from siad window unit, said outer sections of said jamb members each including a corresponding inclined wall portion and having a cross-sectional profile generally the same as the cross-sectional profile of said sill member, said inner sections of said jamb members disposed between said window unit and the corresponding said inclined wall portions of said outer sections, means connecting each of said inner sections to the corresponding said outer section, and said outer sections of said jamb members having mitered corner joints with said sill member and said head member.

2. A window assembly as defined in claim 1 wherein said outer sections of said jamb members each has an inner portion projecting towards the interior of the building and an outer portion projecting towards the exterior of the building, said inner portion of each said outer section has a thickness substantially greater than the thickness of said outer portion of the corresponding outer section, and said inner section of each of said jamb member mounts on said outer portion of the corresponding said outer section.

3. A window assembly as defined in claim 2 wherein said outer portion of each of said outer sections of said jamb members includes said inclined wall portion.

4. A window assembly as defined in claim 1 wherein each of said inner sections of said jamb members defines an elongated said recess in the form of a U-shaped channel, and said window unit is slidably supported by each said channel.

5. A window assembly as defined in claim 1 wherein said inner and outer sections of each of said jamb members include wall portions cooperating to define two C-shaped recesses each having a channel-like cross-sectional configuration.

6. A window assembly as defined in claim 1 wherein said inner and outer sections of each of said jamb members include interfitting ribs and channel-shaped portions adjacent said inclined wall portion.

7. A window assembly as defined in claim 6 wherein said interfitting ribs and channel-shaped portions include means forming a laterally assembled snap-fit connection.

8. A window assembly adapted for use in a vertical wall of a building, comprising a generally rectangular frame supporting a generally rectangular light transmitting window unit, said frame including a pair of elongated vertical jamb members connected by a horizontal head member and a horizontal sill member, each of said members being formed from an extrusion of rigid plastics material, each of said jamb members including an extruded outer section and an extruded inner section, said outer sections of said jamb members each having an inner portion projecting towards the interior of the building and a substantially thinner outer portion projecting towards the exterior of the building, each of said inner sections defining an inwardly facing recess for receiving said window unit, said sill member having an inclined wall portion sloping downwardly and outwardly from said window unit, said outer portions of said outer sections of said jamb members each including a corresponding inclined wall portion and having a cross-sectional profile generally the same as the cross-sectional profile of said sill member, said inner sections of said jamb members disposed between said window and the corresponding said inclined wall portions of said outer sections, means connecting each of said inner sections to the corresponding said outer section, and said outer sections of said jamb members having mitered corner joints with said sill member and said head member.

9. A window assembly as defined in claim 8 wherein said outer sections of said jamb members each includes means adjacent the corresponding said inclined wall for forming a continuous lateral snap-fit connection with the corresponding said inner section.

10. A window assembly as defined in claim 8 wherein each of said inner sections of said jamb members defines an elongated said recess in the form of a C-shaped channel, and said window unit is slidably supported by each said channel.

11. A window assembly as defined in claim 8 wherein said inner and outer sections of each of said jamb members include wall portions cooperating to define two recesses each having C-shaped cross-sectional configuration.

12. A window assembly as defined in claim 8 wherein said sill member and said outer sections of said jamb members each includes a projecting flange portion facing the interior of the building.

13. A window assembly adapted for use in a vertical wall of a building, comprising a generally rectangular frame supporting a generally rectangular light transmitting window unit, said frame including a pair of elongated vertical jamb members connected by a horizontal head member and a horizontal sill member, each of said member being formed from an extrusion of rigid plastics material, each of said jamb members including an extruded tubular outer section and an extruded tubular inner section, said inner sections of said jamb members defining inwardly facing channel-like tracks adapted to receive slide members for supporting said window unit, said sill member having an inclined wall portion sloping downwardly and outwardly from said window unit, said outer sections of said jamb members each including a corresponding inclined wall portion and having a cross-sectional profile generally the same as the cross-sectional profile of the said sill member, said inner sections of said jamb members disposed between said window unit and the corresponding said inclined wall portions of said outer sections, and means forming a continuous lateral snap-fit connection of each said inner section to the corresponding said outer section.

14. A window assembly as defined in claim 13 wherein said inner and outer sections of each of said jamb members include wall portions cooperating to define two C-shaped recesses each having a channel-like cross-sectional configuration.

15. A window assembly as defined in claim 13 wherein said inner and outer sections of each of said jamb members include interfitting ribs and channel-shaped portions adjacent said inclined wall portion and forming said snap-fit connection.

16. A window assembly adapted for use in a vertical wall of a building, comprising a generally rectangular frame supporting a set of generally rectangular light transmitting window units, said frame including a pair of elongated vertical jamb members connected by a horizontal head member and a horizontal sill member, each of said members being formed from an extrusion of rigid plastics material, each of said jamb members including an extruded outer section and an extruded inner section, said inner sections of said jamb members being substantially narrower than said outer sections and disposed between said outer sections and one of said window units, means connecting said inner section of each said jamb member to the corresponding said outer section, said inner sections of said jamb members cooperating with said outer sections to define inwardly facing channels adapted to receive members for supporting said window units, said sill member and head member each including a section with a cross-sectional profile generally the same as the cross-sectional profile of said outer sections of said jamb members, and said outer sections of said jamb members having mitered corner joints with said sections of said sill member and said head member.

17. A window assembly as defined in claim 16 wherein said outer sections of said jamb members each has an inner portion projecting towards the interior of the building and an outer portion projecting towards the exterior of the building, said inner portion of each said outer section has a thickness substantially greater than the thickness of said outer portion of the corresponding outer section, and said inner section of each of said jamb member mounts on said outer portion of the corresponding said outer section.

18. A window assembly as defined in claim 16 wherein said inner and outer sections of each of said jamb members include interfitting ribs and channel-shaped portions forming said connection.

* * * * *